US011524755B2

(12) United States Patent
Czernik

(10) Patent No.: US 11,524,755 B2
(45) Date of Patent: Dec. 13, 2022

(54) SECOND-STAGE DIVING REGULATOR

(71) Applicant: XDEEP Spółka z ograniczoną odpowiedzialnością, Góra (PL)

(72) Inventor: Piotr Czernik, Góra (PL)

(73) Assignee: XDEEP SPOLKA Z OGRANICZONA ODPOWIEDZIALNOSCIA, Gora (PL)

( * ) Notice: Subject to any disclaimer, the term of this patent is extended or adjusted under 35 U.S.C. 154(b) by 639 days.

(21) Appl. No.: 16/589,831

(22) Filed: Oct. 1, 2019

(65) Prior Publication Data

US 2020/0031443 A1 Jan. 30, 2020

Related U.S. Application Data

(63) Continuation of application No. PCT/IB2018/052460, filed on Apr. 9, 2018.

(30) Foreign Application Priority Data

Apr. 11, 2017 (PL) ..... 421288

(51) Int. Cl.
*B63C 11/22* (2006.01)

(52) U.S. Cl.
CPC ..... *B63C 11/2227* (2013.01)

(58) Field of Classification Search
CPC ..... B63C 11/00; B63C 11/02; B63C 11/18; B63C 11/186; B63C 11/20; B63C 11/202; B63C 11/22; B63C 11/2227; B63C 11/2236; B63C 2011/182
See application file for complete search history.

(56) References Cited

U.S. PATENT DOCUMENTS

| | | | |
|---|---|---|---|
| 3,179,118 | A | 4/1965 | Mitchell et al. |
| 3,633,611 | A | 1/1972 | Macniel |
| 4,140,112 | A | 2/1979 | Kobzan |
| 4,214,580 | A | 7/1980 | Pedersen |
| 4,676,238 | A | 6/1987 | Wetzel et al. |
| 4,784,129 | A | 11/1988 | Garraffa |

(Continued)

FOREIGN PATENT DOCUMENTS

| | | |
|---|---|---|
| EP | 0 345 479 A1 | 12/1989 |
| EP | 0 759 314 A1 | 7/1996 |

OTHER PUBLICATIONS

International Preliminary Report on Patentability with written opinion issued by the International Searching Authority for corresponding International Patent Application No. PCT/IB2018/052460, dated Jun. 14, 2018.

*Primary Examiner* — Colin W Stuart
(74) *Attorney, Agent, or Firm* — Myers Wolin, LLC

(57) ABSTRACT

A second stage diving regulator with separated stages that allows changing a position of connection of a LP hose for low pressure supplied from a first stage of the regulator, characterized in that around connected bodies there is a rotating ring with a valve seat and a valve terminated with a thread to which a low pressure LP coming from the first stage of the machine is connected horizontally. The rotation of the rotary ring is ensured at least in the range of 180 degrees from the starting position, through all the intermediate angles downwards towards the cylinder, up to a horizontal position opposite to the starting position, the side of the body.

8 Claims, 6 Drawing Sheets

(56) References Cited

U.S. PATENT DOCUMENTS

| | | | | |
|---|---|---|---|---|
| 5,213,095 | A * | 5/1993 | Dague | F16L 27/02 128/205.24 |
| 5,233,976 | A * | 8/1993 | Ferguson | B63C 11/2227 251/360 |
| 5,501,213 | A * | 3/1996 | Jackson | B63C 11/2227 128/205.24 |
| 6,932,085 | B2 | 8/2005 | Krawczyk et al. | |
| 2002/0134385 | A1 | 9/2002 | Pietrelli | |
| 2005/0022816 | A1 | 2/2005 | Krawczyk et al. | |
| 2014/0102453 | A1 * | 4/2014 | Cavaliere | H01R 35/025 128/204.21 |

* cited by examiner

SECOND-STAGE DIVING REGULATOR

CROSS REFERENCE TO RELATED APPLICATIONS

This application is a continuation under 35 U.S.C. § 120 of International Application PCT/IB2018/052460, filed Apr. 9, 2018, which claims priority to Polish Application No. P.421288, filed Apr. 11, 2017, the contents of each are incorporated by reference herein.

FIELD OF THE INVENTION

A second stage diving regulator with separated stages that allows changing position of a connection of the LP hose for low pressure supplied from the first stage of the regulator

BACKGROUND

The device is an element of a diving equipment for the particularly specialized technical diving. Technical diving is a form of diving to high depths that requires decompression under water. This type of diving often takes place in flooded closed spaces (with ceiling above the head of a scuba diver) with no sunlight and no a water surface visibility. Standards for the scuba diving equipment designed for technical diving are much higher and much more strict than those provided for recreational diving. For example, technical diving may refer to submerged industrial installations, caves or ship wrecks. Due to the high danger and little space for maneuvering, the equipment for such type of diving must be characterized by an intuitive operation, a simple design and reliability and each element of the equipment must be duplicated. When staying deep under water in confined space, in the dark a diver is not able to use additional tools or search for small items associated with a device control. Additionally, a configuration of the gas cylinder used for breathing must be taken into consideration. Due to the necessary decompression, which involves using different gas mixtures on individual stages of diving, a diver does not take just one cylinder, as it is practiced in recreational diving, but usually from three to six. The first pressure reducer (called the first stage of the diving regulator) is mounted directly to the cylinder and connected with a flexible hose to the second stage of the breathing regulator, a mouthpiece of which is placed in the mouth of the diver. This hose connection between the first and second stage of the diving regulator in practice creates problems and can limit a freedom of movements, particularly in tight confined space (caves or shipwrecks), in which the normal practice is taking one of the side cylinder off in order to reduce the outline of the diver body to allow going through narrow passages with a small cross-section of the passage way. The device according to the applicant's solution reduces these problems and inconveniences.

The solution has application to all configurations of diving equipment, allowing changes of the standard position of the LP low pressure hose from the right or the left side without use of additional tools. For example, for technical divers or at side configuration called "side mount", used also in recreational diving.

A design of two-stage regulators for scuba divers is known from a U.S. Pat. No. 3,179,118. U.S. Pat. Nos. 3,633,611, 4,140,112, and 4,214,580 also describe designs of the second-stage regulator for scuba divers with separable stages.

In the referenced designs, a body of regulator is a whole by connection of two or more elements fixed with screws or clamps. The LP low pressure hose connecting both of its parts is the first stage of the pressure reducer, which is mounted on the cylinder with the second stage, which includes a mouthpiece, normally enters on one side and is connected to the second stage of the diving regulator in specifically determined position on the left or right side. In this type of constructions, an adjustment of the position of the connected hose is not possible.

There are also known and available second-stage regulators, in which with help of tools is possible to disassemble the regulator and to change a mount position of the valve and LP hose for low pressure supplied from the first-stage regulator, as a result of which it is possible to connect on the left or right side of the equipment. However, inconvenience of these types of solutions is the fact that due to the precise construction of the regulator, significant number of parts and a need for specialized tools, it becomes not feasible under water.

U.S. Pat. No. 4,784,129 and No. US 20020134385 also present second-stage breathing regulators for scuba divers with a compact, an one-part body made of plastic material. Patent description No. US 20050022816/U.S. Pat. No. 6,932,085 discloses a second-stage regulator, construction of which allows rotation of a mouthpiece, which results in swiveling of the exhaust valve. Inconvenience of this solution is that air bubbles exhaled by the diver are within diver's view, thus making observation difficult.

SUMMARY

The essence of the solution implemented according to the present application consists in the fact that the second stage of the breathing regulator includes a modular body and a swiveling ring allowing its free rotation by at least 180 degrees with respect to the valve body, on which the LP hose for low pressure from the first stage of the breathing regulator is mounted.

Swiveling of the ring with the valve can be started from the position, in which the LP hose is connected on the left side of the body and diver, through all in-between angles downwards to the cylinder, up to the position, in which the LP hose is connected on the right side of the body and diver. A symmetrical variant, in which the hose is connected on the right side in the initial position with swiveling to the opposite side by max. 180 degrees until the left side of the body is also possible. Swiveling through all in-between angles downwards to the cylinder is much more functional, as in case of rotation upwards through the upper half of the circumference, the LP hose would be in the diver's field of view and obstruct the view.

Likewise, bubbles of exhaled air would be just at the front of the diver's mask, making observation difficult. A rotation of the ring with the valve can be realized by a sliding connection and a circular movement in guides, as well as by mating of toothed edges of the swiveling ring periphery and the body and also through other know methods of swivel adjustment.

A cylindrical front part of the regulator consists of the front body and inflator button. The inflator button consists of an elastic inhaling membrane, fixed permanently to the pressure element that secures the membrane in the point where the membrane mates with the valve lever, perforated membrane cover, elastic element of the inflator button and a nut that secures all those elements. The front body has grooves for the gasket and a guide of the swiveling ring. Suitable profiling of the front body allows 180 degree rotation of the valve.

The cylindrical rear part of the breathing regulator consists of the rear body, exhaust valve, mouthpiece and exhaust tee. The rear body has grooves for the gasket and guide of the swiveling ring. Suitable profiling of the rear body allows 180 degree rotation of the valve. On the swiveling ring, there is a valve seat and guides of the ring preventing movement of the ring and regulator leakage.

It is preferred to use a button locking the rotation of the ring, allowing blocking of the swivel of the ring with the valve in specific predefined positions, e.g. every 30 degrees or 45 degrees.

The valve with a lever is mounted on the ring with the use of a nut and is provided with grooving under the gasket preventing the body leaks. Length and construction of the valve including the lever allow its operation in any possible setting—from 0 degrees to 180 degrees.

The two body parts are connected with bolts, after mounting of the swivel ring. It is preferred to be able to use a simplified, two-element construction of the second-stage breathing regulator. In the case of a two-element body, the rear part of the body with the mouthpiece, exhaust valve and exhaust tee, remains fixed with relation to the diver, while the front part of the body with the inflation valve and its elements constitutes one part with the swivel ring and turns by 180 degrees according to the same principle as in the three-element variant.

In both construction variants of the second stage of breathing regulator, it is preferred that the exhaust valve together with the exhaust tee, regardless of the position of the ring with the valve, is always located in the bottom position thanks to which the exhaled air bubbles do not obstruct diver's field of view.

It is preferred in both regulator variants to use a locking button allowing blocking of the rotation of the ring with the mounted valve in defined positions, for example in five positions every 45 degrees or in seven positions every 30 degrees, allowing 180-degree rotation.

It is preferred in both regulator variants that the change of directions in which the LP low pressure hose is entered into the first stage of the regulator does not require valve repositioning of the whole valve or using any tools.

BRIEF DESCRIPTION OF THE DRAWINGS

The object of the solution is presented in the embodiment a diving regulator, where.

DETAILED DESCRIPTION OF THE PREFERRED EMBODIMENTS

Figure 1:
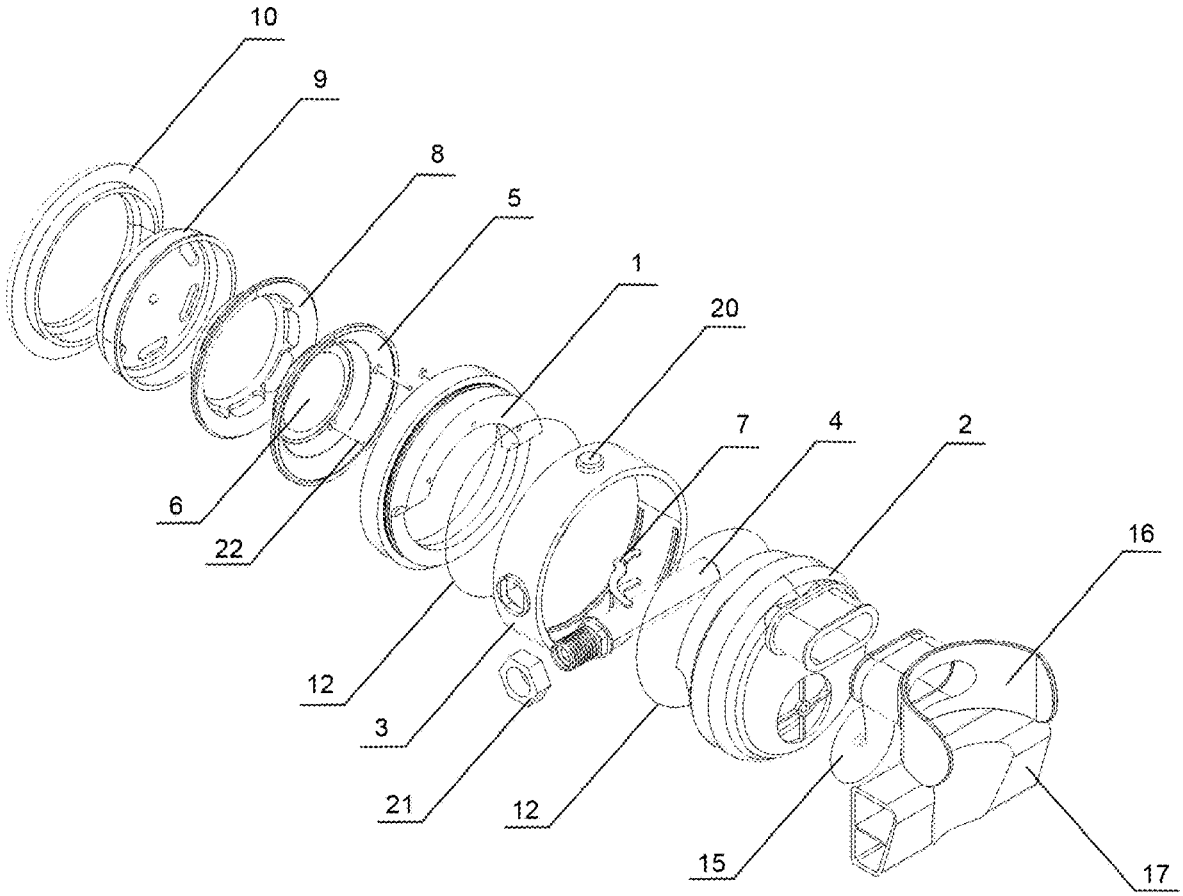
FIG. 1 shows an isometric view with of the assembly of the second stage of the breathing regulator in a three-element variant.
Figure 2:
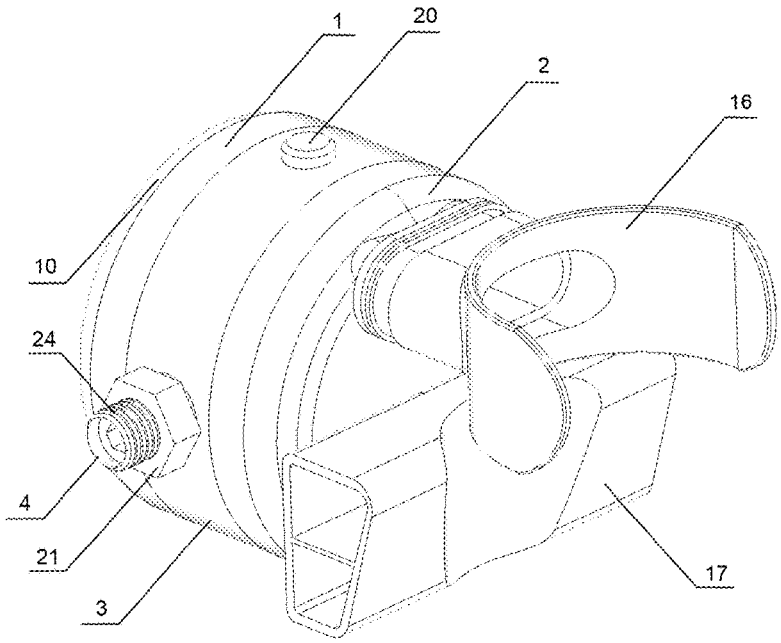
FIG. 2 shows an isometric view of the second-stage breathing regulator with the ring and valve at the first neutral position—0 degrees in a three-element variant.
Figure 3:
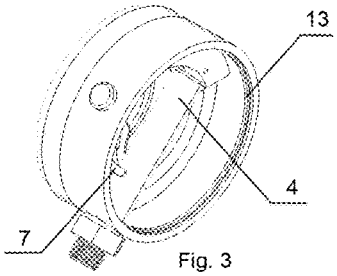
FIG. 3 shows an isometric view with the ring and valve at the second intermediate position—45 degrees without visible rear body in a three-element variant.
Figure 4:
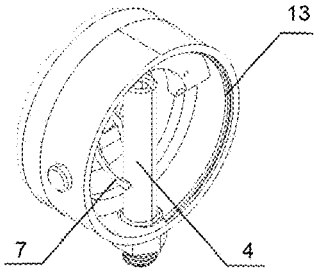
FIG. 4 shows an isometric view with the ring and valve at the third intermediate position—90 degrees without visible rear body in a three-element variant.
Figure 5:
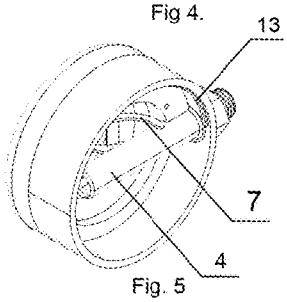
FIG. 5 shows an isometric view with the ring and valve at the fifth extreme intermediate position—180 degrees without visible rear body in a three-element variant.
Figure 6:
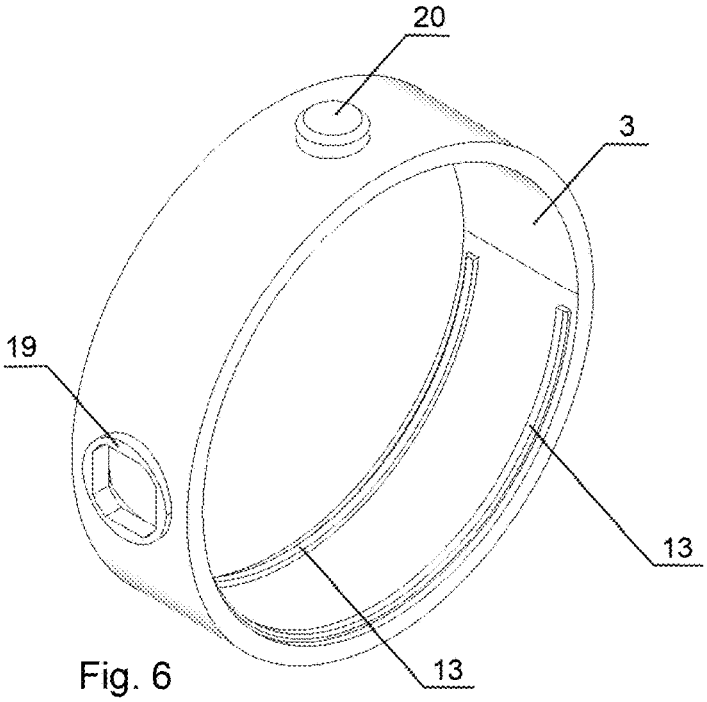
FIG. 6 shows an isometric view of the swivel ring of the second-stage breathing regulator.
Figure 7:
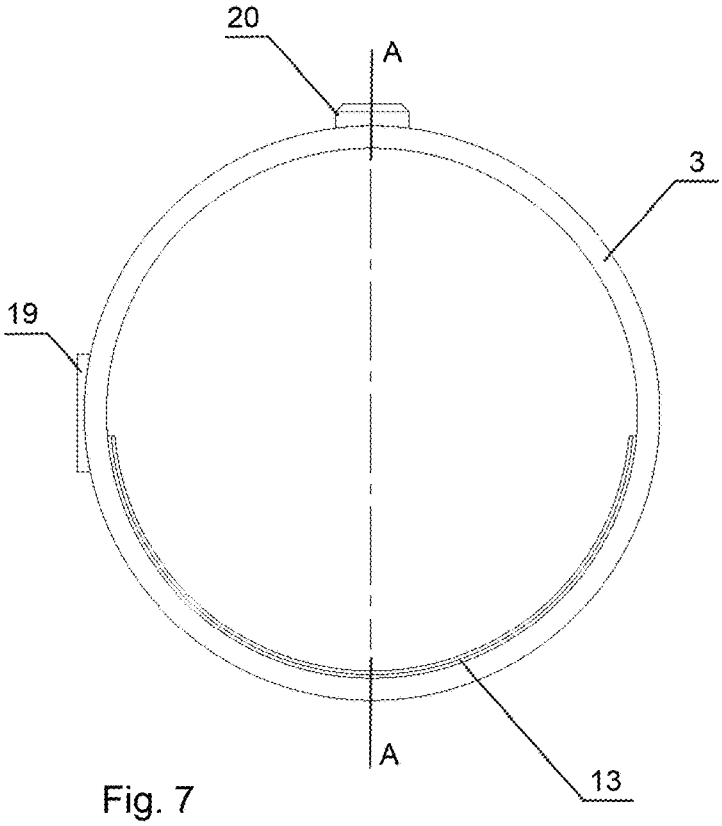
FIG. 7 shows a front view of the swivel ring of the second-stage breathing regulator.
Figure 8:
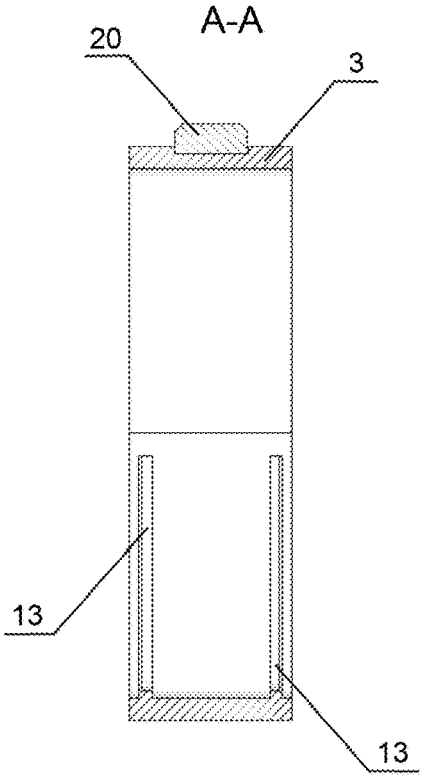
FIG. 8 shows a cross-section along line A-A of FIG. 7 of the swivel ring of the second stage of the breathing regulator.
Figure 9:
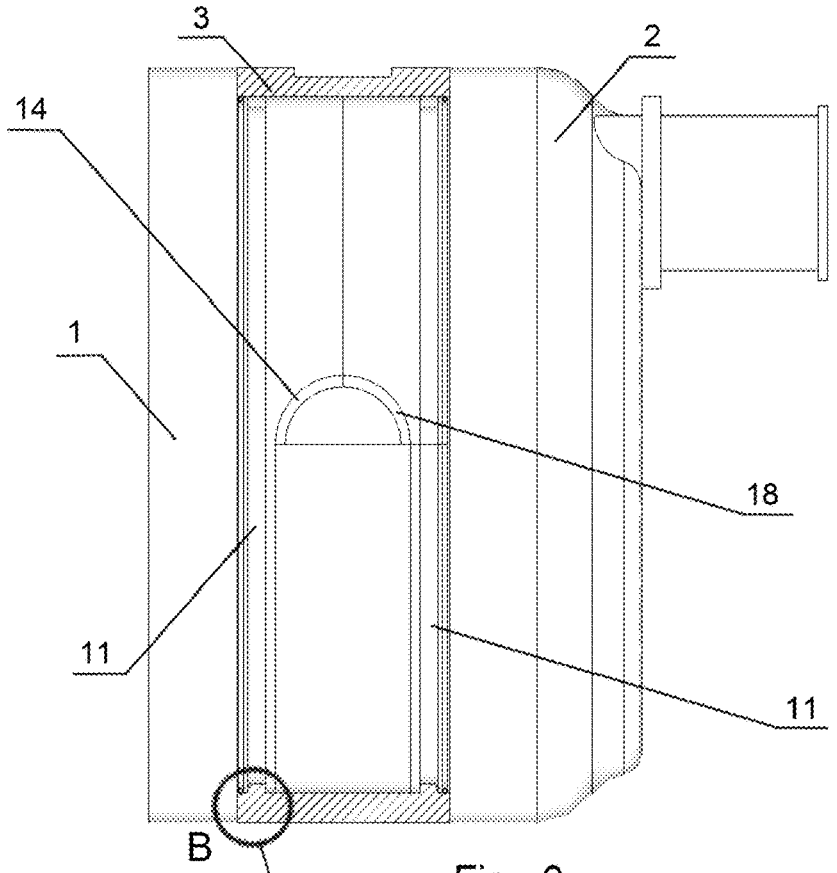
FIG. 9 shows a side view of the connection of the front and rear part of the body of the second-stage breathing regulator, with a cross-section of the swivel ring along line A-A of FIG. 7.
Figure 10:
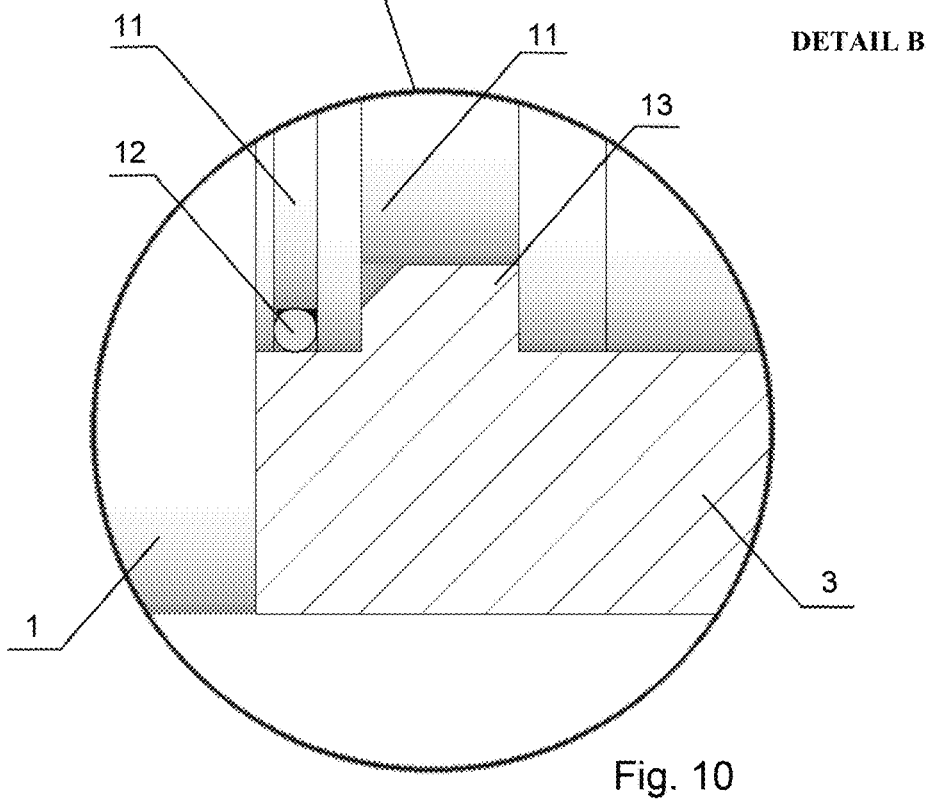
FIG. 10 shows a detail B on FIG. 9.
Figure 11:
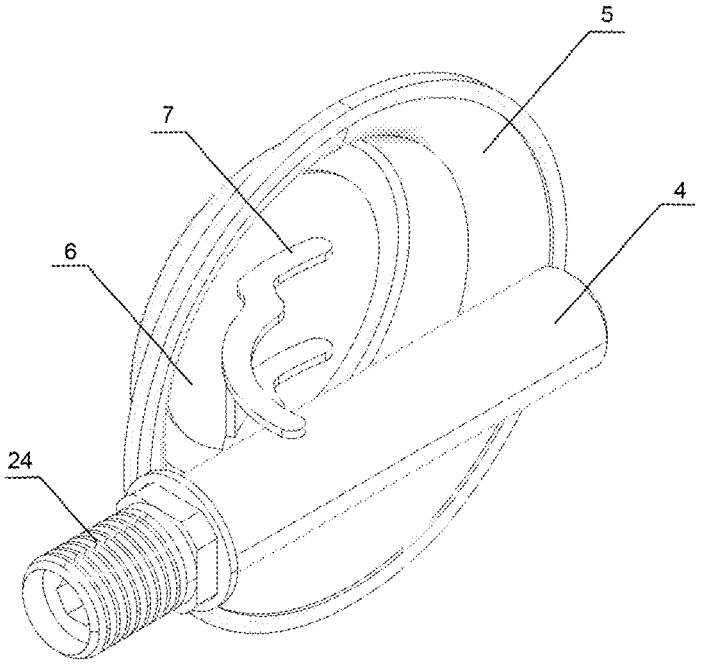
FIG. 11 shows an isometric view of the elastic membrane with the securing element and the valve with valve lever mating with the membrane.
Figure 12:
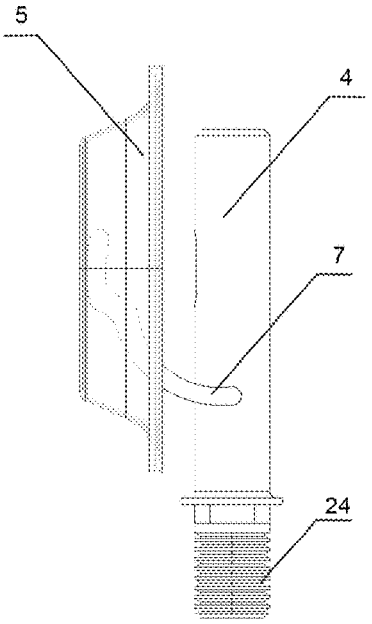
FIG. 12 shows a side view of the elastic membrane with the securing element and the valve with valve lever mating with the membrane.
Figure 13:
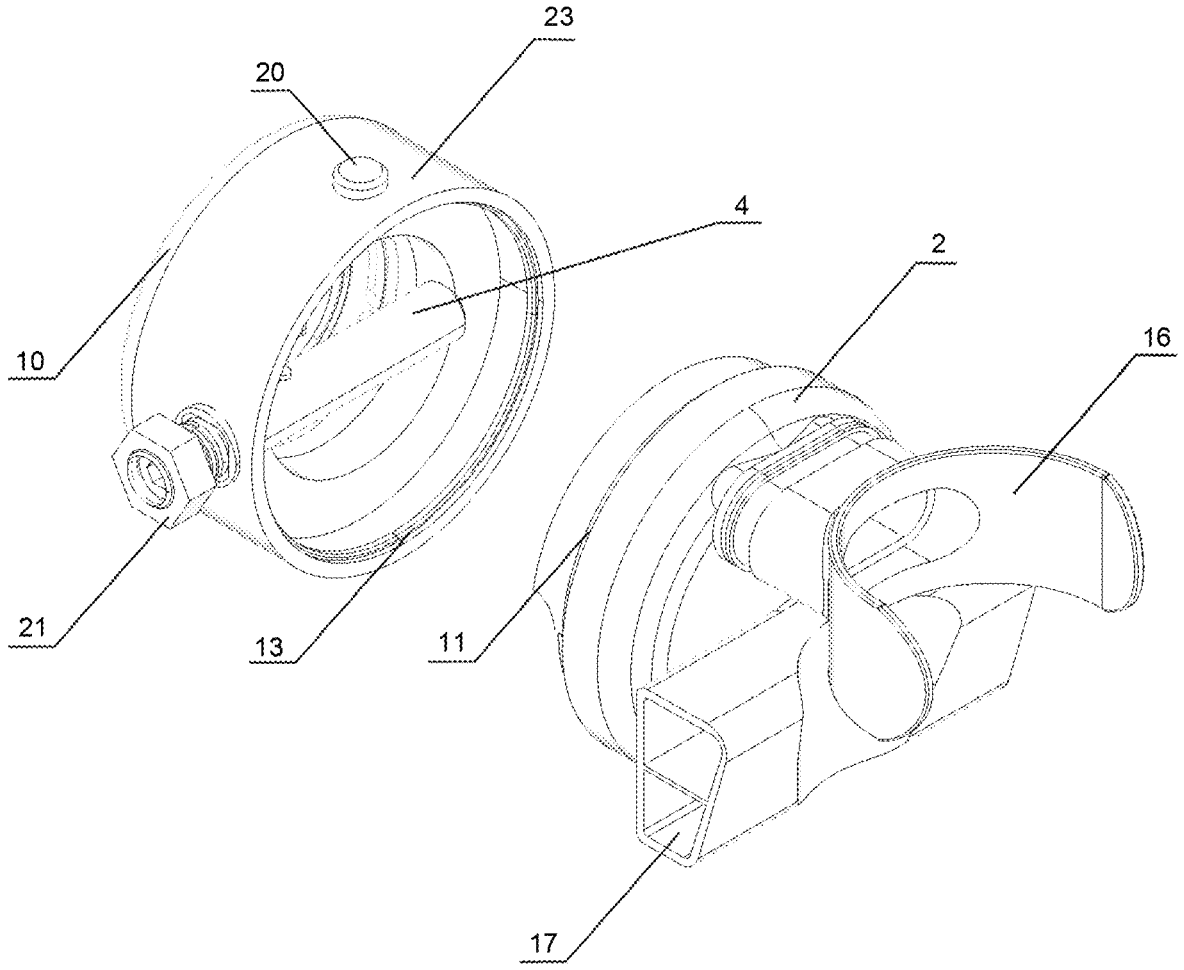
FIG. 13 shows an isometric assembly view of two parts of the body of the second-stage breathing regulator in the first neutral position—0 degrees, in a two-element variant.

The second stage of the breathing regulator for scuba diving includes the front body (1), rear body (2) and swivel ring (3) allowing free rotation by at least 180 degrees with respect to both body parts (1, 2) of the valve (4) on which the LP hose for low pressure from the first stage of the breathing regulator is mounted. Swiveling of the ring (3) with the valve (4) can be started from the position, in which the LP hose is connected on the left side of the body (1, 2) and a diver, through all in-between angles downwards, until the position, in which the LP hose is connected on the right side of the body (1, 2) and a diver.

Cylindrical front part of the regulator consists of the front body (1) and the inflator button. The inflator button consists of an elastic inhaling membrane (5), fixed permanently to a pressure element (6) securing the membrane at the point of mating with the valve lever (7), perforated membrane cover (8), elastic element of the inflator button (9) and the nut securing all elements (10) tightened to the front body (1). The front body (1) has grooves (11) for the gasket (12) and guide (13) of the swivel ring (3). In the embodiment of the solution, the swiveling ring (3) rotates by sliding movement in the guides (13). Appropriate profiling (14) of the front body (1) allows 180-degree rotation of the valve (4).

The cylindrical rear part of the regulator consists of the rear body (2), membrane of the exhaust valve (15), mouthpiece (16) and exhaust tee (17). The rear body (2) has grooves (11) for the gasket (12) and guide (13) of the swivel ring (3). Appropriate profiling (18) of the rear body (2) allows 180-degree rotation of the valve (4).

On the swivel ring (3) there is a valve seat (19). Swiveling through all in-between angles downwards to the tank is much more functional, as in case of rotation upwards through the upper half of the circumference, the LP hose will not be in the diver's field of view and obstruct the view.

The valve (4) with the lever (7) is mounted to the ring (3) with the nut (21), has grooves for the gasket preventing from body leaks and is ended with thread (24) allowing connection of the LP hose for low pressure from the first stage of the breathing regulator. Length of the valve (4) and shape and construction of the lever (7) allow operation in any possible position of the swivel ring (3)—from 0 degrees to 180 degrees.

The exhaust valve with the exhaust valve membrane (15) together with the exhaust tee (17), regardless of the position of the ring (3) with the mounted valve (4), is always located in the bottom position thanks to which the exhaled bubbles of air are outside the diver's field of view.

The used locking button (20) allows blocking of the rotation of the ring (3) with the mounted valve (4) in five positions every 45 degrees allowing full 180-degree rotation.

Change of direction in which the LP low pressure hose is routed to the first stage of the regulator does not require rearrangement of the whole valve (3) or using any tools.

In a simplified, two-element construction of the second stage of the breathing regulator for scuba divers, the front body (1) and swivel ring (2) constitute a single element—the front part of the body with the ring (23).

In the simplified two-element construction of the second-stage breathing regulator for scuba divers, the rear part of the body (2), with the mouthpiece (16), exhaust valve (15) and exhaust tee (17), remains fixed with relation to the diver, while the entire front part of the body, with the ring (23) and valve seat (19) and the inflator button, turns by 180 degrees according to the same principle as in the three-element variant. A guide of the ring (13) is on the entire internal circumference of the front body with the ring (23) and constitutes an element that connects 2 bodies. The inflator button consists of the elastic inhaling membrane (5), fixed permanently to a pressure element (6) securing the membrane in the point of mating with the valve lever (7), perforated membrane cover (8), elastic element of the inflator button (9) and the nut securing all elements (10) tightened to the front body with the ring (23).

Two parts of the body, the front body with the ring (23) and the rear body (2) are clamped with the guide of the ring (13) located on the whole circumference of the front body with the ring (23) moving in the groove of the ring (11) of the rear body (2). Tightness of the construction is ensured by using of the gasket (12) placed in the groove (11) of the rear body (2).

The exhaust valve (15) with the exhaust tee (17), regardless of the position of the ring (23) with the mounted valve (4), is always located in the bottom position thanks to which the exhaled bubbles of air are outside the diver's field of view.

The used locking button (20) allows blocking of the rotation of the ring (23) with the mounted valve (4) in five positions every 45 degrees allowing a full 180-degree rotation.

Change of direction in which the LP low pressure hose is routed to the first stage of the regulator does not require rearrangement of the entire valve (3) and using any tools.

What is claimed is:

1. A second stage diving regulator comprising of a front body and an inflator button equipped with an elastic inhaling membrane connected with a pressure element securing the membrane with a valve lever, a perforated diaphragm cover, an elastic element of the inflator button and a nut all fastening to the front body connected to a rear body provided with an exhaust valve membrane and to a mouthpiece and an exhaust tee, characterized in that a swivel ring is connected between the front body and the rear body, the swivel ring including a valve seat, a valve, and a thread to which a low pressure (LP) hose from a first stage of a breathing system is connected, the swivel ring configured to allow the thread to be rotated from one lateral side of the second stage diving regulator to an opposite lateral side.

2. The second stage diving regulator according to claim 1, wherein the front body and the rear body have grooves for guides of the swivel ring.

3. The second stage diving regulator according to claim 1, wherein the front body and the rear body have grooves for gaskets preventing device leaks.

4. The second stage diving regulator according to claim 1, wherein the swivel ring has on its internal side guides configured to move in grooves of the front body and the rear body.

5. The second stage diving regulator according to claim 1, wherein a profiling of the front body and a profiling of the rear body allows full 180-degree rotation of the swivel ring with the valve.

6. The second stage diving regulator according to claim 1, wherein the exhaust tee is always located in a bottom position, regardless of position of the ring with the valve.

7. The second stage diving regulator according to claim 1, wherein a locking button allows rotation of the ring by a specifically set angle.

8. The second stage diving regulator according to claim 1, wherein the front body and the swivel ring are fixed permanently.

* * * * *